United States Patent [19]

Schönmeier

[11] 4,183,474

[45] Jan. 15, 1980

[54] APPARATUS FOR WINDING MATERIAL IN WEB FORM

[75] Inventor: Herbert Schönmeier, Dusseldorf, Fed. Rep. of Germany

[73] Assignee: Jagenberg Werke AG, Dusseldorf, Fed. Rep. of Germany

[21] Appl. No.: 937,906

[22] Filed: Aug. 29, 1978

[30] Foreign Application Priority Data

Sep. 28, 1977 [DE] Fed. Rep. of Germany ..... 2743616

[51] Int. Cl.[2] ..... B65H 17/08

[52] U.S. Cl. ..... 242/66

[58] Field of Search ..... 242/66, 65, 58.6, 56 R, 242/56.9

[56] References Cited

U.S. PATENT DOCUMENTS 3,817,467 6/1974 Dambroth ..... 242/56 R 3,910,517 10/1975 Harrison ..... 242/66

FOREIGN PATENT DOCUMENTS 1435525 5/1976 United Kingdom ..... 242/66

*Primary Examiner*—Edward J. McCarthy

*Attorney, Agent, or Firm*—Sprung, Felfe, Horn, Lynch & Kramer

[57] ABSTRACT

An apparatus for winding material in web form into a roll lying upon two spaced apart driven support cylinders and having a cylindrical roll core. A stand-by roll core is supported between the roll and the supporting cylinders during the winding of the roll by a support member which defines a supporting surface thereon and which is mounted for movement from a non-supporting position to a supporting position wherein the supporting surface lies in a horizontal plane and extends into the area between the supporting cylinders and the roll to such an extent that only one supporting cylinder at a time can be contacted linearly by the stand-by roll core.

8 Claims, 3 Drawing Figures

APPARATUS FOR WINDING MATERIAL IN WEB FORM

BACKGROUND

The invention relates to an apparatus for the winding of material in web form, such as paper webs, into a roll which is cradled between two driven supporting cylinders and has a cylindrical core.

In apparatus of this kind, after the roll has been completely wound, the web of material is severed and the roll is ejected from the cradle formed by the supporting cylinders. Then a fresh roll core is placed manually in the supporting cylinder cradle. During the severing of the web, the ejection of the wound roll and the insertion of the new roll core, the apparatus is stopped. For the purpose of shortening this down time, it is known from DT-OS 2,032,724 to push the next roll core into the cylinder cradle, i.e., into the gap between the supporting cylinders and the roll, from one end while the winding is still in progress, so that, after the roll has been finished, the winding of the fresh roll core can begin after a brief stop. During the period in which the next roll core is laid down between the supporting rolls and is waiting to be used, the core is revolving about its axis, because it is making linear contact on one side with the one supporting roll and on the other side with the web carried on the other supporting roll. Since the diameter of the roll core is relatively small, it rotates about its longitudinal axis at a relatively high speed, so that it tends to vibrate and jump about. This can do damage not only to the roll core, which is made of cardboard tubing, but also to the web material.

THE INVENTION

It is the object of the invention to improve an apparatus of the above-described kind so as to prevent damage to the roll core or to the web material.

This object is accomplished in accordance with the invention in that support is provided between the supporting cylinders for the next roll core which is not wound with material, by a lowerable supporting means having a horizontal supporting surface or supporting points lying in a horizontal plane and extending so far into the gap between the supporting cylinders and the roll that only one of the supporting cylinders can make linear contact with the roll core.

By the supporting means of the invention the roll core is lifted so far out of the gap between the supporting rolls that its weight is carried substantially by the supporting means and it can engage only one supporting cylinder. In this manner a support is provided for the roll core and rotation of the core is prevented. Damage to the web material and to the roll core is reliably prevented.

In one embodiment, the invention proposes that the supporting points of the supporting means be formed of small, horizontal rollers disposed transversely of the roll core axis. In this manner the roll core can be introduced between the supporting cylinders with especial ease. An especially simple design is provided by situating a flat iron vertically between the supporting cylinders with its long axis parallel to the supporting cylinder axis. To increase the stability of the flat iron, a beam of triangular cross section can be affixed to its bottom margin, parallel thereto, with one of its longitudinal edges extending into the lower part of the gap formed between the supporting cylinders.

The introduction of the roll core can also be facilitated if the supporting surface or supporting points project at least at one end beyond the end faces of the supporting cylinders. For the lowering of the supporting means, the latter can have end rollers running in two guiding grooves, the grooves being able to be vertical in the area of the supporting cylinders and curved away in a lower area.

A drive for the supporting means that is of simple and space-saving design is created by making the supporting means movable by means of a pair of forks which can rotate about the axis of one supporting cylinder and each of which straddles an end pin or end roller on the supporting means.

BRIEF DESCRIPTION OF THE DRAWINGS

The invention will be better understood with reference. to the following drawings wherein.

DETAILED DESCRIPTION OF THE INVENTION

Figure 1:
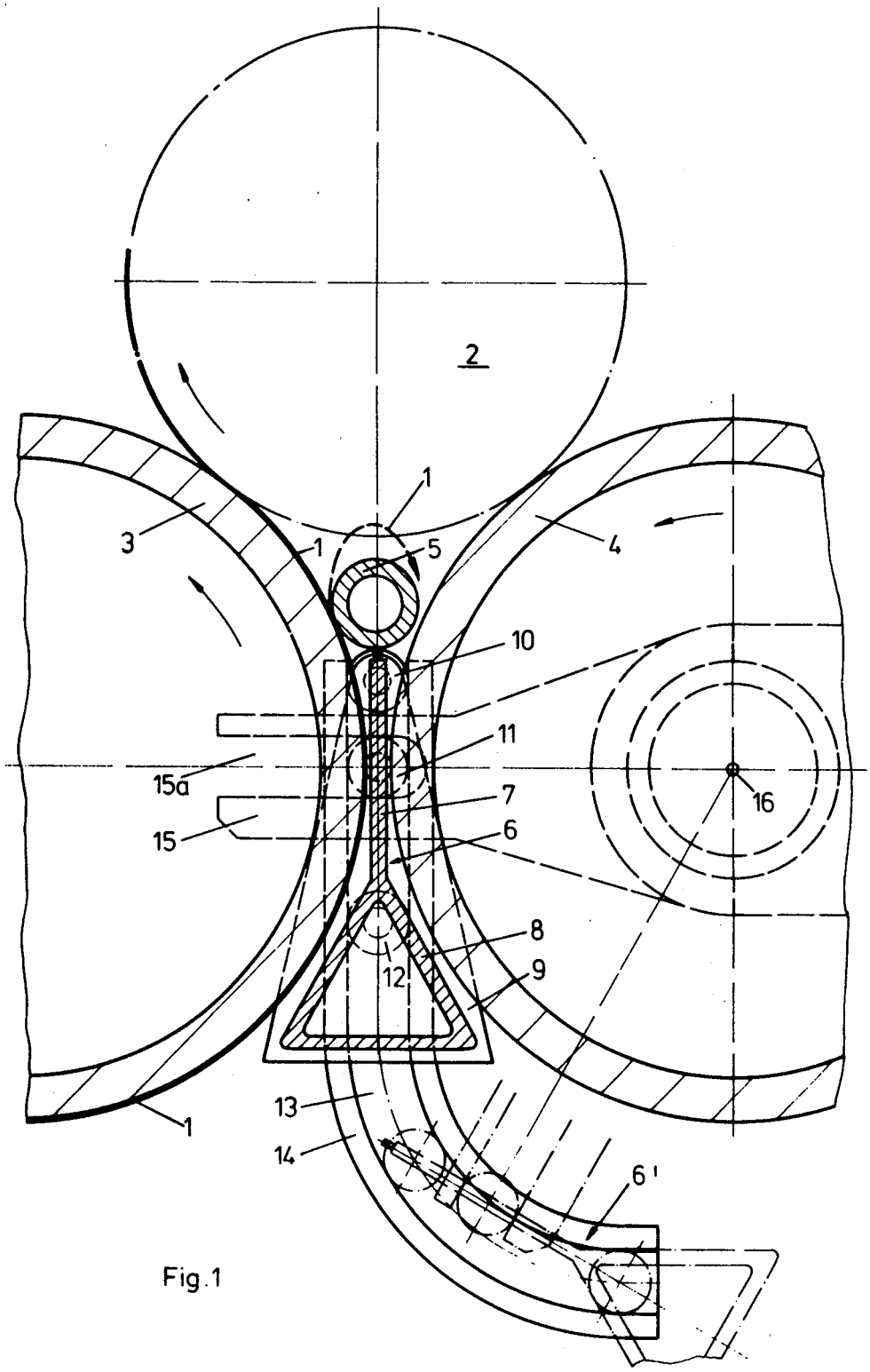
FIG. 1 is a vertical cross section along the 1—1 of FIG. 3 of the apparatus of the invention.
Figure 2:
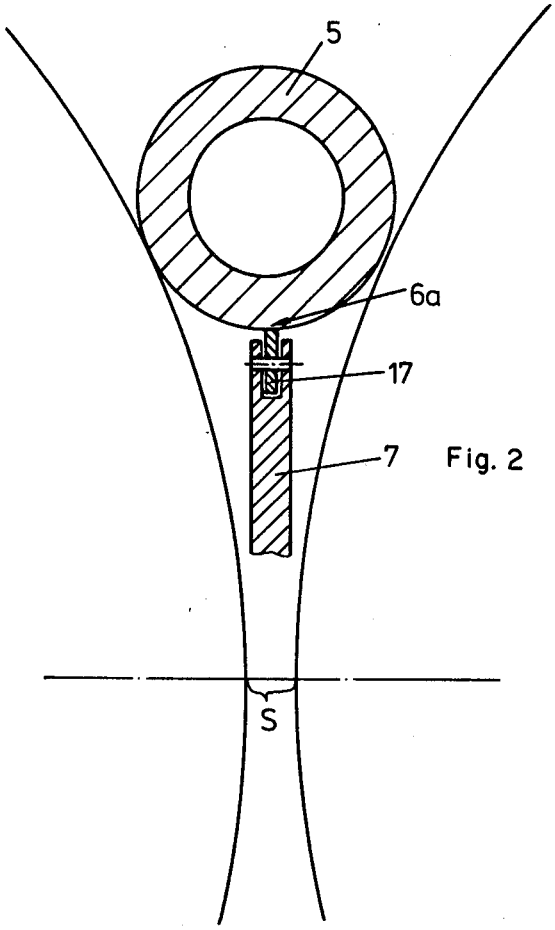
FIG. 2 is a vertical cross section of a detail of FIG. 1.
Figure 3:
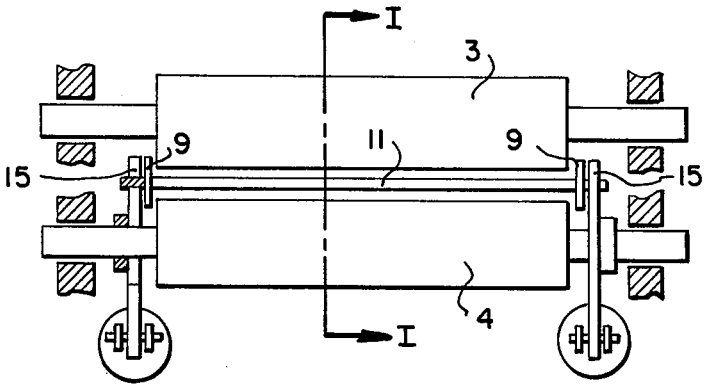
FIG. 3 is a bottom view of the apparatus of the invention

As shown in FIGS. 1-3 two parallel supporting cylinders 3 and 4, which are not movable towards one another, are mounted in journals which are not shown, and they are driven in the same sense. The axes of the supporting cylinders are situated at the same level, and the peripheries of the cylinders are situated so close to one another that they form a narrow gap S.

In the upper, V-shaped interstice between the supporting cylinders, a roll core 5 lies parallel to the supporting cylinders and its bottom rests on a supporting means 6. The top supporting surface or top supporting points 6*a*, as the case may be, of the supporting means 6 extend so far into the upper, V-shaped space that the roll core 5 can come into contact either with only one supporting cylinder or with the paper web 1. The supporting means consists of a vertical flat iron 7 disposed in gap S parallel to the supporting cylinders, and to its bottom there is welded a beam 8 of triangular cross section which is composed of three flat irons, one of which forms a horizontl bottom. To the opposite ends of the flat iron 7 and of the beam 8 there are welded triangular, vertical plates 9 each of which has three rollers 10, 11 and 12 arranged vertically above one another. The rollers 10 and 12 are situated in the groove 13 of a guide 14 which is vertical in an upper portion and bent away in a lower portion, so that, when the supporting means 6 descends it will be canted. Thus, the supporting means 6 will be able to be reached in the upper as well as in the lower position by two forks 15 which are mounted for rotation about the axis 16 of the supporting cylinder 4, and can each engage with their radial slots 15*a* the roller 11 which is situated between the rollers 10 and 12. The two forks 15 are disposed one on either side of the supporting means 6 and are driven by means in FIG. 3 shown.

The flat iron 7 is of greater length at one end than the supporting cylinders 3 and 4, so that the supporting surface 6*a* projects at one end beyond the end faces of the supporting cylinders. Small rollers or wheels 17 are horizontally disposed on the supporting surface 6a with their axes disposed transversely of the longitudinal axis of the supporting means and the axes of rotation of the supporting cylinders.

The supporting means 6 is in its lower position 6' when the paper web 1 is first introduced. The paper web 1 running on the supporting cylinder 3 is threaded from below into the gap S and brought to the roll core 5 which is cradled on the pair of supporting cylinders in the absence of other support. The paper web is wrapped about the roll core 5 and, after start-up, i.e., while the supporting cylinders 3 and 4 are rotating, the paper web 1 is wound onto it, so that the circumference of the roll core 5 grows and a paper roll develops. As the roll increases steadily in diameter, it rises up out of the V-shaped gap between the supporting cylinders, so that a space forms between the supporting cylinders 3 and 4 and roll 2 into which the next roll core 5 can be inserted while the supporting cylinders are rotating and before roll 2 has been completely wound. Before the next roll core 5 is inserted, the supporting means 6 is raised so as to form a supporting surface 6a for the roll core 5. As soon as roll 2 has reached its desired size, the machine is stopped, the paper web is severed and, after the supporting means 6 is lowered, the web is wound onto the roll core already lying in place.

It will be appreciated that the instant specification and claims are set forth by way of illustration and not limitation, and that various changes and modifications may be made thereto without departing from the spirit and scope of the present invention.

What is claimed is:

1. In an apparatus for winding material in web form into a roll lying upon two spaced apart driven supporting cylinders and having a cylindrical roll core, the improvement comprising means for supporting a stand-by roll core between the roll and the supporting cylinders during the winding of the roll comprising a support member defining a supporting surface thereon and means mounting same for movement from a non-supporting position to a supporting position wherein the supporting surface lies in a horizontal plane and extends into the area between the supporting cylinders and the roll to such an extent that only one supporting cylinder at a time can be contacted linearly by the stand-by roll core.

2. The apparatus according to claim 1, wherein the supporting member comprises rollers disposed transversely of the roll core axis to define the supporting surface.

3. The appaatus according to claim 1, wherein the supporting member comprises a flat portion with perpendicular faces and a longitudinal axis parallel to the supporting cylinder axes and positionable between the supporting cylinders.

4. The apparatus according to claim 3, wherein the supporting member further comprises a portion connected to the underside of the flat portion and parallel therewith and having a beam of triangular cross section with one longitudinal edge extendable into the lower portion of the gap formed by the supporting cylinders.

5. The apparatus according to claim 1, wherein the supporting surface projects at least at one end beyond the end faces of the supporting cylinders.

6. The apparatus according to claim 1, wherein the mounting means comprises means defining two guide grooves and two end rollers movable therein and connected to the support member.

7. The apparatus according to claim 6, wherein the guide grooves are perpendicular in the area of the supporting cylinders and are curved away in a lower area.

8. The apparatus according to claim 6, wherein the mounting means further comprises an intermediate roller between the two end rollers, two forks which are rotatable about the axis of one supporting cylinder, and in each of whose slots the intermediate roller is engaged to move the support member along the path defined by the guide grooves in response to the rotation of the forks.

* * * * *